US009292005B2

(12) United States Patent
Hessler

(10) Patent No.: US 9,292,005 B2
(45) Date of Patent: Mar. 22, 2016

(54) SHOCK RESISTANT BEARING FOR A TIMEPIECE

(71) Applicant: The Swatch Group Research and Development Ltd, Marin (CH)

(72) Inventor: Thierry Hessler, St-Aubin (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/364,550

(22) PCT Filed: Dec. 7, 2012

(86) PCT No.: PCT/EP2012/005050
§ 371 (c)(1),
(2) Date: Jun. 11, 2014

(87) PCT Pub. No.: WO2013/087173
PCT Pub. Date: Jun. 20, 2013

(65) Prior Publication Data

US 2014/0341005 A1 Nov. 20, 2014

(30) Foreign Application Priority Data

Dec. 12, 2011 (EP) ..... 11193058

(51) Int. Cl.
*G04B 31/004* (2006.01)
*G04B 31/02* (2006.01)
*G04B 31/06* (2006.01)

(52) U.S. Cl.
CPC ..... *G04B 31/004* (2013.01); *G04B 31/02* (2013.01); *G04B 31/06* (2013.01)

(58) Field of Classification Search
CPC ..... G04B 31/00; G04B 31/02; G04B 31/04; G04B 31/06; G04B 31/012; G04B 31/016; G04B 31/004
See application file for complete search history.

(56) References Cited

U.S. PATENT DOCUMENTS 3,306,027 A * 2/1967 Schneider ..... 368/326
3,790,237 A * 2/1974 Quaile et al. ..... 384/125

(Continued)

FOREIGN PATENT DOCUMENTS

CH 700 496 B1 9/2010
EP 1 462 879 A2 9/2004

(Continued)

OTHER PUBLICATIONS

English Translation of Von Gunten, CH 700,496, electronically translated Apr. 22, 2015.*

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Shock resistant bearing for a timepiece including an elastic structure and a central portion carried by the elastic structure, the central portion having a blind hole intended to receive a pivot of a rotating wheel set of the timepiece. The elastic structure and the central portion are formed by a single-piece part formed of single crystal quartz and the blind hole has at least partially the shape of a truncated or non-truncated trigonal pyramid against which the end of the pivot abuts. The invention also concerns a method of manufacturing a shock resistant bearing of this type wherein the single-piece wafer is machined in an anisotropic etching bath for single crystal quartz. Preferably, two masks are respectively arranged on the two sides of the wafer to simultaneously etch the quartz from both sides.

9 Claims, 4 Drawing Sheets

(56) References Cited

U.S. PATENT DOCUMENTS

| | | | | |
|---|---|---|---|---|
| 3,942,848 | A * | 3/1976 | Voumard | 384/125 |
| 6,806,797 | B2 * | 10/2004 | Kikushima | G01C 19/5607 29/25.35 |
| 7,394,326 | B2 * | 7/2008 | Takizawa | G01C 19/56 310/370 |
| 7,550,905 | B2 * | 6/2009 | Tanaya | H03H 9/1021 310/321 |
| 8,317,391 | B2 | 11/2012 | Conus et al. | |
| 8,446,079 | B2 * | 5/2013 | Fang | H03H 9/21 310/370 |
| 2006/0187767 | A1 * | 8/2006 | Conus et al. | 368/324 |
| 2011/0164478 | A1 | 7/2011 | Conus et al. | |
| 2013/0188462 | A1 * | 7/2013 | Helfer et al. | 368/326 |

FOREIGN PATENT DOCUMENTS

| | | | |
|---|---|---|---|
| EP | 1 986 059 | A1 | 10/2008 |
| EP | 2 015 147 | A2 | 1/2009 |
| FR | 2 164 937 | A1 | 8/1973 |
| FR | 2 279 140 | A1 | 2/1976 |
| FR | 2 363 727 | A1 | 3/1976 |
| WO | 2009/060074 | A1 | 5/2009 |

OTHER PUBLICATIONS

International Search Report issued in corresponding application PCT/EP2012/005050, completed Apr. 18, 2013 and mailed Apr. 24, 2013.

* cited by examiner

SHOCK RESISTANT BEARING FOR A TIMEPIECE

This is a National phase application in the United States of International Patent application PCT/EP2012/005050 filed Dec. 7, 2012, which claims priority on European Patent Application No. 11193058.2 filed Dec. 12, 2011. The entire disclosures of the above patent applications are hereby incorporated by reference.

FIELD OF THE INVENTION

The present invention concerns the field of shock resistant bearings (bearings with a shock absorber device) for a timepiece and the methods of manufacturing the same. In particular, the invention concerns a shock resistant bearing intended to receive a pivot of the balance staff of a mechanical watch movement.

BACKGROUND OF THE INVENTION

CH Patent 700496 describes a shock resistant bearing formed by single crystal silicon and including a central portion and radial elastic arms connecting this central portion to a peripheral annular portion. The central portion includes a flared hole having the shape of a four-sided pyramid. First of all, it will be noted that the bottom of a four-sided hole is not optimum for supporting a pivot. As regards the making of a hole of this type, the above Patent provides anisotropic wet chemical etching. To achieve this, it is mentioned that the silicon substrate must be oriented properly to enable machining of the pyramid-shaped hole. Next, to machine the rest of the single-piece silicon part and in particular the elastic arms, the above Patent proposes using another machining technique, namely deep reactive ion etching (DRIE). This latter technique requires complex expensive plants which are different from those used for anisotropic wet chemical etching. Thus, the manufacturing cost of shock resistant bearings according to the teaching of the above Patent is relatively high. It will be noted that the use of two different techniques in different plants to machine the silicon parts does not arise from a propensity of the authors of CH Patent No 700496 to needlessly complicate the method of manufacturing silicon shock resistant bearings. It results in fact from a requirement arising from the properties of single crystal silicon. Indeed, the orientation of the silicon substrate required to obtain the flared pyramid-shaped hole cannot provide an elastic structure with arms having substantially vertical lateral walls, or the peripheral annular portion.

Generally, the present inventor has observed that silicon does not permit the machining of a structure with substantially vertical walls and exhibiting curvature by means of etching in an acid bath. Further, to obtain apertures in a single crystal silicon wafer with vertical walls, only specific silicon crystal orientations in the wafer are possible (incompatible with the orientation for obtaining pyramid-shaped holes). The possible directions for such vertical walls are limited and the vertical walls are only formed of plane surfaces.

WO Patent Application No 2009/060074 describes shock resistant bearings including a single-piece silicon part and a pierced stone associated therewith. This single-piece part defines an elastic structure and an endstone. It is formed in a silicon wafer using the well known techniques of photolithography and etching. This Patent document mentions that single-piece parts can be made of silicon or another preferably single crystal material easily machinable by photolithography and chemical etching techniques. No example is given other than silicon. As regards silicon, as mentioned above, although it is possible to obtain slots or apertures with vertical walls, designs are limited. In particular, it is not possible to obtain all the designs shown in the Figures of the above Patent document by chemical etching of a silicon crystal wafer. The teaching of the above Patent concerning the method of manufacturing shock resistant bearings made of single crystal material remains vague. Only the case of silicon is explicitly mentioned. The limits and drawbacks of a silicon crystal embodiment were set out in the discussion of CH Patent No 700496. Further, the meaning given to chemical etching here is not clear. In any event, it may be concluded that elastic structures such as those shown in the Figures are not made in an acid bath, but rather by deep reactive ionic etching as in CH Patent No 700496.

The Applicant of WO Patent Application No 2009/060074 also filed EP Patent Application No 2015147 (same priority dates). This latter document discloses a shock resistant bearing formed by a disc of single crystal material; said disc defining an elastic structure and a central portion with a blind hole intended to receive a balance pivot. In a variant, the elastic structure defines three interleaved spirals. The blind hole has a flat bottomed cylindrical shape, as shown in the Figures. It will be noted that the flat bottomed cylindrical shape is not optimum since the pivot moves and rubs against the cylindrical portion in an erratic manner, because the hole is wider than the portion of the pivot introduced therein. According to a main embodiment, that Patent document proposes using a single crystal silicon disc or wafer, which is machined using the well known techniques of photolithography (also called chemical processes).

SUMMARY OF THE INVENTION

It is an object of the present invention to answer the problem of the complex and expensive machining of single-piece single crystal parts, and to provide a shock resistant bearing, formed by a single-piece part defining an elastic structure and a central portion in which there is machined a hole intended to receive a pivot of a rotating wheel set, which can be machined industrially at a relatively low cost yet is of high quality.

It is another object of the invention to provide a shock resistant bearing of the aforementioned type which has a blind hole whose shape is advantageous for properly centering the axis of the rotating wheel set pivoted in this blind hole and for minimising friction.

It is another object of the present invention to provide a shock resistant bearing which is attractive and which has a particular recognisable appearance.

The present invention concerns a shock resistant bearing for a timepiece including an elastic structure and a central portion carried by this elastic structure, this central portion having a blind hole intended to receive a pivot of a rotating wheel set of the timepiece. The elastic structure and the central portion are formed by a single-piece part formed of single crystal quartz and the blind hole has three oblique facets together defining a truncated or non-truncated trigonal pyramid.

In a preferred variant, the single-piece part is a pierced wafer whose axis perpendicular to its two main faces is almost parallel to the optic axis of the single crystal quartz.

The present invention also concerns two main implementations of a method for manufacturing a shock resistant bearing wherein the elastic structure and a central portion, carried by the elastic structure and having a blind hole, are made of single crystal quartz.

The manufacturing method according to the invention makes it possible to obtain a high quality transparent shock resistant bearing by a relatively inexpensive method which only requires machining in chemical baths. Further, this method makes it possible to machine a blind hole for the bearing whose bottom is at least partially defined by a trigonal pyramid against whose faces the pivot of a rotating wheel set abuts. This blind hole ensures improved centering of the axis of the rotating wheel set and also minimises friction. A transparent bearing also has a technical advantage in that it makes it easier to check the presence of oil in the hole.

Other particular features and advantages of the invention will be set out below in the detailed description of the invention.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
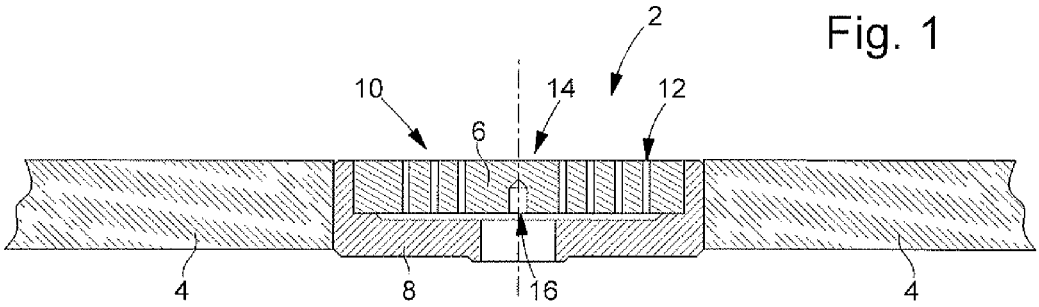
FIG. 1 is a cross-section of an embodiment of a shock resistant bearing according to the invention.

A shock resistant bearing 2 according to the invention will be described below with reference to FIGS. 1, 2, 3 and 5. This shock resistant bearing is arranged in a bridge or a plate 4 of a timepiece and is formed of a single crystal quartz wafer 6 (the wafer defining a disc or a circular plate) and of a base 8 which has a housing for wafer 6. This wafer includes an elastic structure 10, formed by the substantially circular slots 12 machined in the wafer, and a central portion 14 carried by this elastic structure and having a blind hole 16 intended to receive a pivot of a rotating wheel set (not shown) of the timepiece movement. The slots, substantially shaped in an arc of a circle, define between them elastic spiral arms connecting the central portion to the peripheral area of wafer 6. This elastic structure and the central portion are thus formed by one single-piece part formed of single crystal quartz.

As a result of the arrangement of an elastic structure at the periphery of central portion 14, this latter may undergo movements in the plane of wafer 6 and also, to a certain extent, vertically. For this purpose, a slot is preferably arranged between elastic structure 10 and the bottom of the housing of base 8. Bearing 2 defines a suspended shock resistant bearing. It will be noted that the base includes an aperture for the passage of the arbour of a rotating wheel set and acts as a stop member in the event of a violent axial and/or vertical shock. It will be noted that the stop member may be arranged in various manners and that, in a variant, wafer 6 is directly arranged in the bridge or plate 4 with no intermediate element.

Figure 2:
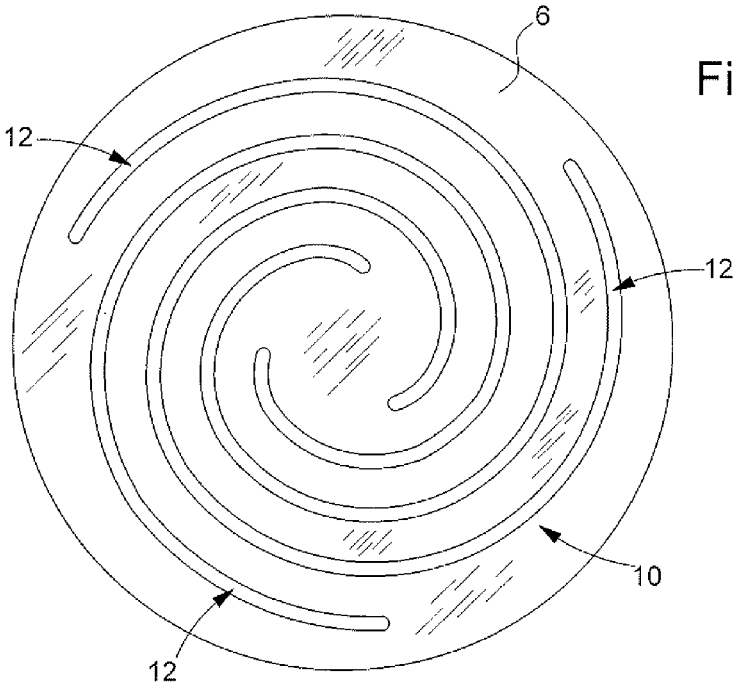
FIG. 2 is a top view of a pierced single crystal quartz disc forming the shock resistant bearing of FIG. 1.

The elastic structure may have numerous design variants in the plane of wafer 6. It is sufficient for central portion 14 to be connected in an elastic manner to the peripheral portion of base 8. However, the arrangement of interleaved spiral arms of the type shown in FIG. 2 is advantageous, since the length of the elastic arms is increased relative to a configuration with radial arms. To achieve this, the choice of a quartz wafer is remarkable since a design of this type may be obtained by an etching process in a bath, which will be explained below.

Figure 5:
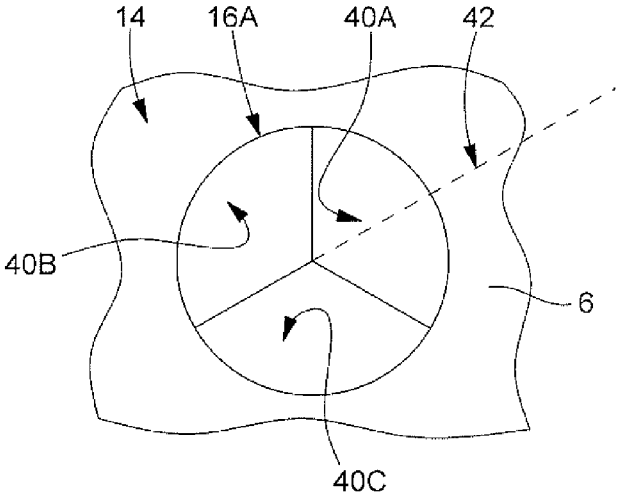
FIG. 5 is a plan view of a blind hole obtained in the quartz wafer machined according to the method of the invention.

According to the invention, blind hole 16, machined in the bottom face of central portion 14, has three oblique facets 40A, 40B, 40C together at least partially defining a trigonal pyramid (see FIG. 5). According to a variant, each of the three facets defines an angle of around 40° with the central axis Z of the blind hole, i.e. the median straight line 42 of each of these facets defines an angle of around 40° with the central axis of the blind hole. The bottom of the blind hole, may have other facets (see FIG. 6), particularly when the diameter of the hole becomes larger. These different facets originate from the quartz etching provided by the manufacturing method according to the invention described below.

Figure 7:
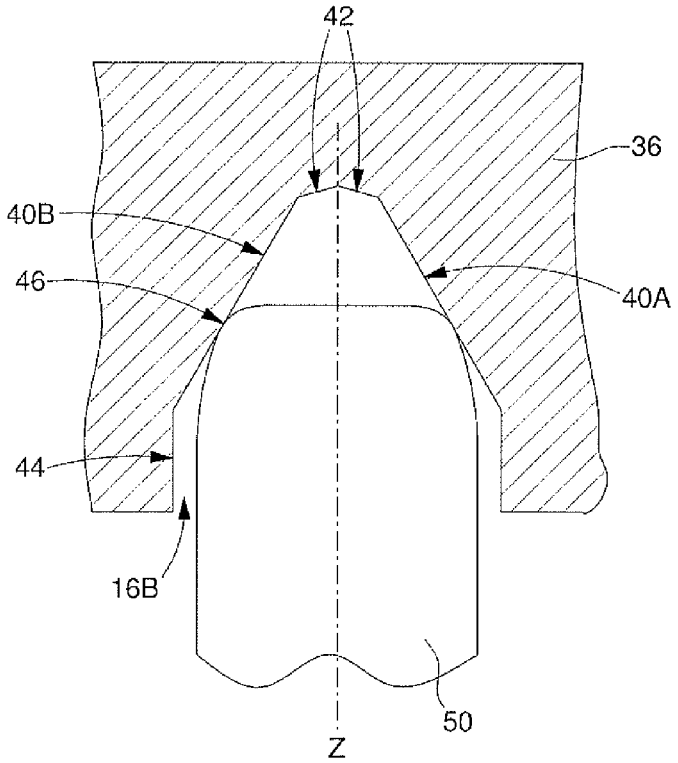
FIG. 7 is a cross-section along the line VII-VII of FIG. 6, for a variant which differs from that of FIG. 6 only in that the initial portion of the blind hole does not have a vertical wall but nonetheless has an abrupt slope.

In a preferred variant, the blind hole also has a substantially vertical lateral wall in the initial portion thereof (see FIG. 7). Thus, the three facets do not extend as far as the external face of the single-piece part where the blind hole opens out and the lateral surface of the blind hole between the external face and the three facets has a steeper gradient or gradients than that of the three facets. According to a particular variant, the gradient or gradients defined by the lateral surface of the blind hole is/are less than twenty degrees (20° relative to the central axis of the blind hole.

Figure 3:
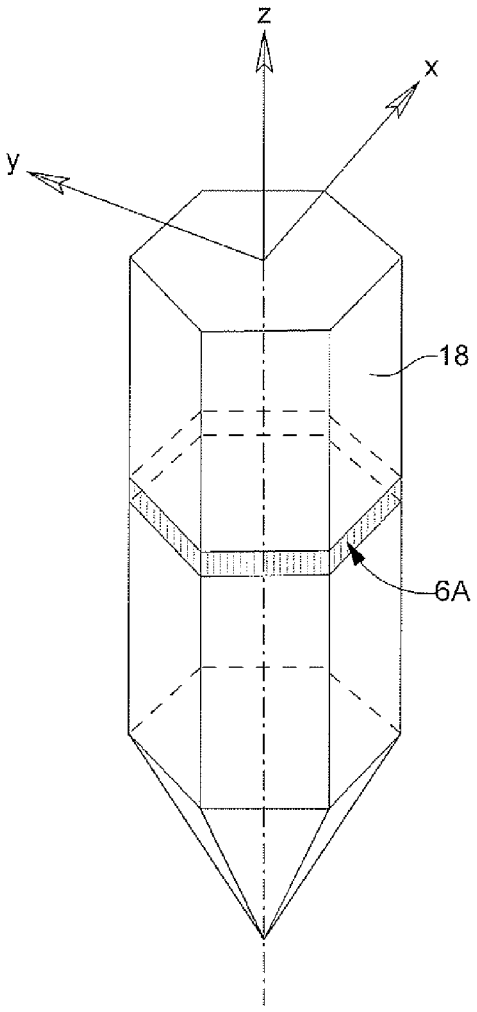
FIG. 3 is a schematic, perspective view of a crystal of single crystal quartz in which there a wafer is cut to be used for manufacturing the pierced disc of FIG. 2.

According to a preferred embodiment, the single crystal quartz wafer 6 is selected so that axis Z perpendicular to the two main faces thereof, is approximately the optical axis of the single crystal quartz. FIG. 3 shows schematically a quartz crystal 18 and a slice 6A which is cut into the quartz crystal to manufacture a plate in which wafer 6 according to the invention is then machined.

According to a first alternative or a first implementation of the method of manufacturing a shock resistant bearing of the type including an elastic structure and a central portion carried by the elastic structure and having a blind hole intended to receive a pivot of a rotating wheel set of the timepiece, said elastic structure and said central portion being formed by one single-piece part, the following steps are provided:

A) Making a single crystal quartz wafer whose two main faces, respectively the first and second faces, are substantially oriented perpendicularly to the optical axis of the crystalline structure of the single crystal quartz;

B) Forming a first mask on the first face of the single crystal quartz wafer, said first mask being structured by photolithography so as to define on said first face the contours of the elastic structure and of the blind hole arranged in said wafer;

C) Machining the elastic structure and the blind hole in the single crystal quartz wafer by inserting said wafer into a chemical etching bath suited for an anisotropic etch of single crystal quartz which greatly facilitates an etch along the optical axis, the first mask being selected to resist the etch of this etching bath.

It will be noted that in the case of a relatively small hole diameter, in particular smaller than around 120 microns (120 μm), the speed at which the hole is formed along the central axis thereof is lower than the machining speed, in the direction of said axis, of the elastic structure so that it is possible to simultaneously obtain the blind hole and the elastic structure by an etch simply from the first face.

According to a preferred variant, the machined elastic structure has a design with curved slots and/or apertures whose edges at least partially have curved lines; which optimises the elastic structure as explained above.

Figure 4A:
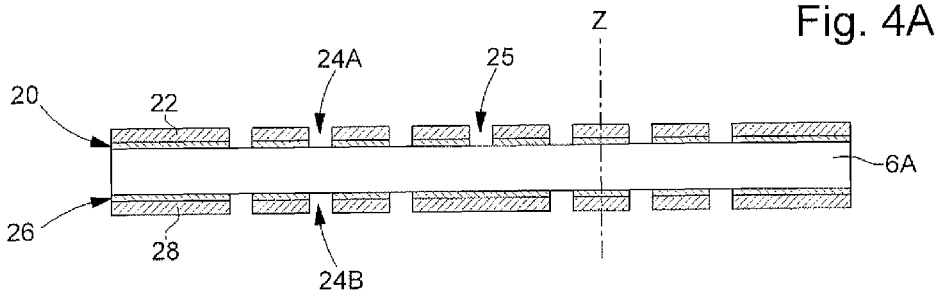
FIG. 4A is a cross-section of a quartz wafer coated on the two main faces thereof with a mask selected to resist a quartz etching bath.
Figure 4B:
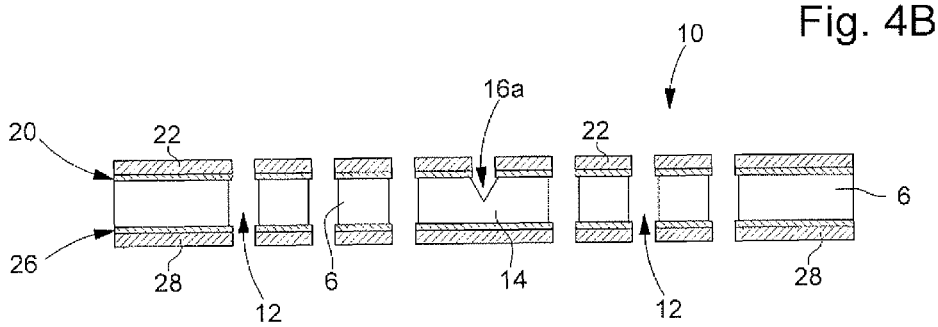
FIG. 4B is a schematic cross-section of the wafer of FIG. 4A after machining in a chemical bath arranged for anisotropic etching of quartz.

In a preferred variant of this first implementation, shown in FIGS. 4A and 4B, the following steps are provided:

A) Making a single crystal quartz wafer 6A whose two main faces, respectively the first and second faces, are substantially oriented perpendicularly to the optical axis Z of the crystalline structure of the single crystal quartz;

B) Forming a first mask 20 on the first face of the single crystal quartz wafer, and a second mask 26 on the second face of said wafer, said first and second masks being structured by photolithography so as to define respectively on said first face and said second face the contour of the elastic structure 10, the first mask 20 also defining the contour of the blind hole 16A arranged in wafer 6;

C) Machining elastic structure 10 and blind hole 16A in the single crystal quartz wafer by inserting said wafer into a chemical etching bath adapted to an anisotropic etch of single crystal quartz which greatly facilitates an etch along the optical axis Z, the first and second masks being selected to resist the etch of this chemical etching bath.

Thus, the quartz wafer is simultaneously etched on both sides of the wafer to form the elastic structure. This firstly makes it possible to reduce the machining time in the etching bath and also to obtain apertures with vertical walls. This variant is particularly indicated when the blind hole has a relatively large diameter, particularly more than 150 microns (150 μm). Thus, it is easily possible to make the blind hole simultaneously with the machining of the elastic structure in the same chemical etching bath. However, it will be noted that this variant is advantageous for making the elastic structure even when the blind hole has a smaller diameter.

In a particular variant, the normal to the two main faces of the quartz wafer forms an angle of around two degrees (2° with the optical axis (angle of double refraction) of the crystalline structure of the single crystal quartz. The quartz etching bath contains, in particular, hydrofluoric acid (HF). In a variant it also contains ammonium fluoride ($NH_4F$).

The photolithography method used to make the two masks is standard. A photosensitive layer 22, respectively 28 is deposited on a metal layer 20, respectively 26, for example a chromium-gold layer (Cr—Au). Each photosensitive layer is then selectively illuminated and developed to obtain apertures corresponding to the mask provided. Thus, photosensitive layer 22 has apertures 24A for the elastic structure and an aperture 25 for the blind hole; whereas photosensitive layer 28 has only apertures 24B for elastic structure 10. Once photosensitive layers 22 and 28 have been structured, wafer 6A is placed in the chemical bath adapted to the etch of metal layers 20 and 26 so as to define the two corresponding masks (same references as the metal layers) for the subsequent localised quartz etch.

Finally, wafer 6A provided with its two masks is placed in a chemical bath selected to perform a strongly anisotropic etch of single crystal quartz by facilitating etching substantially on the optical axis Z. After a determined time in the chemical bath, which is a function, in particular, of the thickness of the wafer and also of the depth required for the blind hole, a pierced wafer 6 is obtained with circular slots 12 having substantially vertical walls. Further, there is obtained a blind hole 16A whose bottom has inclined facets as explained above (the symmetrical V-shaped profile in the cross-section of FIG. 4B is schematic, since in a transverse cross-section, two facets of the pyramid are not generally traversed with the same inclination). In the variant shown in FIG. 4B, the bottom of the hole is formed only by a trigonal pyramid. By way of example, wafer 6 has a thickness of around 200 microns and the diameter of the blind hole is 100 or 200 microns.

According to a second alternative or a second implementation of the method of manufacturing a shock resistant bearing of the type described above, the method includes the following steps:

A) Making a single crystal quartz wafer whose two main faces, respectively the first and second faces, are substantially oriented perpendicularly to the optical axis of the crystalline structure of the single crystal quartz;

B) Forming a first initial mask on the first face of the single crystal quartz wafer, said first initial mask being structured by photolithography so as to define on the first face the contour of the elastic structure but not the contour of the blind hole intended to receive the pivot of a rotating wheel set;

C) Partially machining the elastic structure, defined by the first initial mask obtained in step B), in the single crystal quartz wafer by placing said wafer in a chemical etching bath adapted for an anisotropic etch of single crystal quartz greatly facilitating an etch along the optical axis of the single crystal quartz, the first initial mask being selected to resist the etch of the chemical etching bath;

D) Structuring the first initial mask so as to define the contour of the blind hole and to obtain a first final mask;

E) Final machining of the elastic structure and simultaneous machining of the blind hole, defined by the first final mask structured in step D), in the single crystal quartz wafer by placing the wafer in the chemical etching bath again.

Figure 8A:
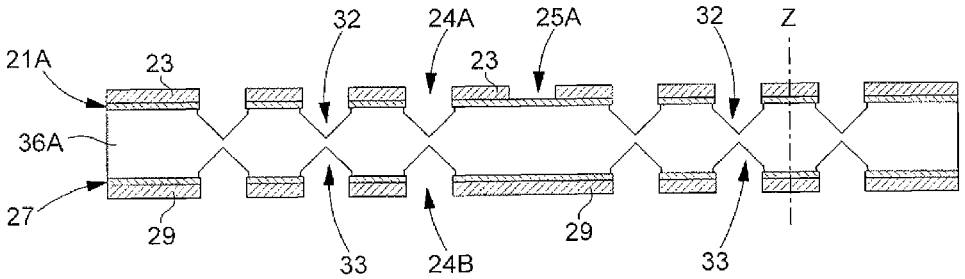
FIGS. 8A and 8B are cross-sections corresponding to FIGS. 4A and 4B with a thicker quartz wafer and a blind hole of greater diameter whose shape is similar to the blind hole shown in FIGS. 6 and 7.
Figure 8B:
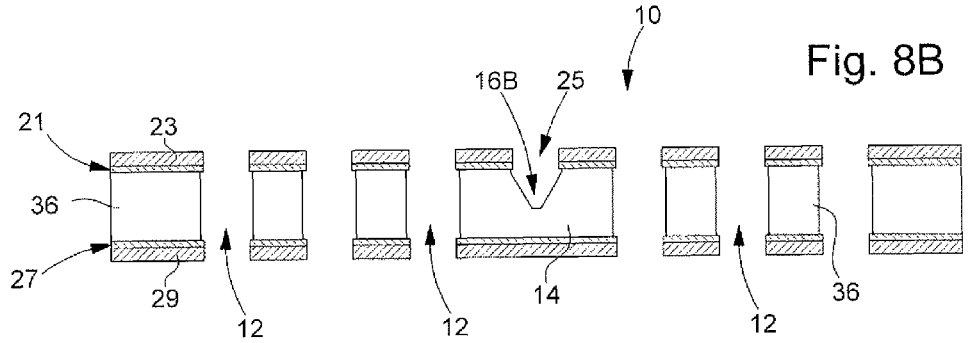

A preferred variant of this second implementation of the method of the invention is shown schematically in FIGS. 8A and 8B. In this preferred variant, prior to step C), a second mask is formed on the second face of the single crystal quartz wafer, said second mask being structured by photolithography so as to define the contour of the elastic structure on said second face. This variant allows an etch of both sides of wafer 36A as shown in FIG. 8A. FIG. 8A shows schematically a cross-section of a single crystal quartz wafer 36A as it appears after step C) of the method according to the variant described here and after illumination and development of photosensitive layer 23 to obtain aperture 25 in said layer for enabling hole 25 (FIG. 8B) to be made in initial mask 21A so as to obtain the final mask 21. This final mask makes it possible to machine blind hole 16B in the final machining phase of elastic structure 10 to obtain the pierced wafer 36 shown in FIG. 8B. The second mask 27 was structured using photosensitive layer 29. To etch masks 21A and 27, photosensitive layers 23 and 29 are respectively structured by photolithography and then respectively have apertures 24A and 24B corresponding to the intended elastic structure 10. Prior to etching aperture 25 in mask 21A, i.e. before step D) of the method described here, wafer 36A is placed in an anisotropic quartz etching bath for a first phase or period. After the wafer has been removed from the bath, the elastic structure is partially machined as shown in FIG. 8A. Grooves 32 and 33 are obtained on the two sides of wafer 36A.

According to a preferred variant, between steps B) and C) mentioned above, photosensitive layer 23, having served for the partial structuring of first initial mask 21A to define the elastic structure, is illuminated to form a hole 25A in the photosensitive layer corresponding to the intended blind hole (FIG. 8A). It will be noted that the development of photosensitive layer 23 to obtain hole 25A may occur before or after step C). The structuring of the first mask is thus achieved here in two phases in an etching bath selected for etching the metal layer deposited on the single crystal quartz wafer and forming said first mask.

The second implementation of the method according to the invention makes it possible to determine two different time periods for machining the elastic structure and machining the blind hole in an anisotropic etching bath for single crystal quartz. This optimises the etching time for the elastic structure and for the blind hole. Thus, by way of example, the single crystal quartz wafer has a thickness of 300 microns and the diameter of the blind hole is equal to around 200 microns. The first etching phase of period of the elastic structure lasts for example around two hours (2 h) and the second etching phase or period of this elastic structure and of the blind hole lasts for example around two hours. The depth of the blind hole is for example between 100 and 150 microns.

Figure 6:
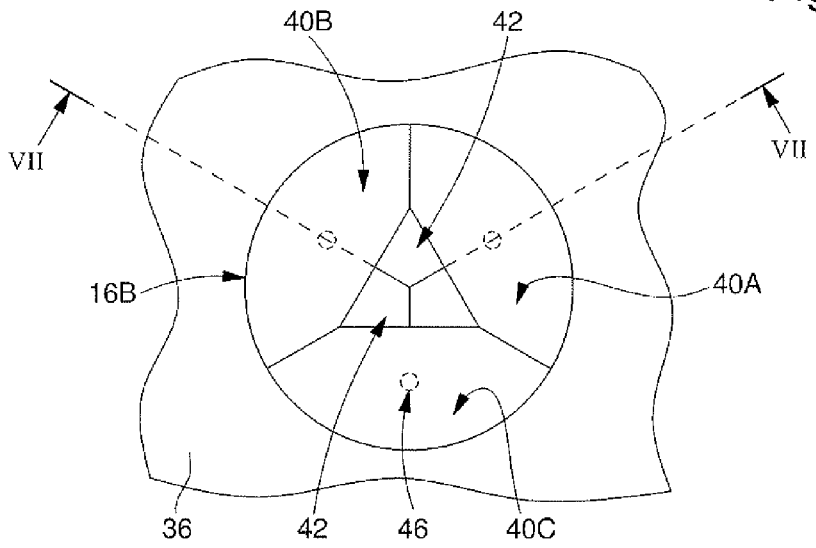
FIG. 6 is a plan view of a second variant of the blind hole obtained in the quartz wafer machined according to the method of the invention.

As shown in FIGS. 6 and 7, in particular when the diameter of the blind hole is more than 150 microns, facets 42 appear in the central area of the bottom of blind hole 16B, each defining a relatively wide angle with vertical axis Z (particularly around 60°, in addition to facets 40A, 40B and 40C of a main trigonal pyramid corresponding to that described in FIG. 5. Thus, this main trigonal pyramid is truncated, i.e. the area of its apex is cut into facets each having a smaller gradient than that of the three facets of the trigonal pyramid. Preferably, blind hole 1B has a substantially vertical wall 44 in the initial portion thereof. Pivot 50 of the arbour of the wheel set introduced into the blind hole is preferably configured so that the points of abutment of said pivot against the bottom of the blind hole are located in areas 46 of the three facets of the main trigonal pyramid which form an angle of substantially 40° with axis of rotation Z of pivot 50.

The invention claimed is:

1. A method for manufacturing a shock resistant bearing including an elastic structure and a central portion carried by said elastic structure, said central portion having a blind hole intended to receive a pivot of a rotating wheel set of the timepiece, the elastic structure and the central portion being formed by one single-piece part, said method comprising:

A) making a single crystal quartz wafer whose two main faces, respectively the first and second faces, are substantially oriented perpendicularly to the optical axis of the crystalline structure of the single crystal quartz;

B) forming a first mask on the first face of the single crystal quartz wafer, said first mask being structured by photolithography so as to define on the first face the contours of said elastic structure and of said blind hole;

C) machining said elastic structure and said blind hole in said single crystal quartz wafer by placing said wafer in a chemical etching bath adapted for an anisotropic etch of single crystal quartz which greatly facilitates an etch along said optical axis, said first mask being selected to resist the etch of said chemical etching bath.

2. The method according to claim 1, wherein, prior to machining said elastic structure and said blind hole, a second mask is formed on the second face of the single crystal quartz wafer, said second mask being structured by photolithography so as to define the contour of the elastic structure on said second face.

3. The method according to claim 1, wherein said machined elastic structure has a design with curved slots and/or apertures whose edges at least partially define curved lines.

4. The method according to claim 1, wherein said blind hole has three oblique facets together defining a truncated or non-truncated trigonal pyramid.

5. A method for manufacturing a shock resistant bearing including an elastic structure and a central portion carried by said elastic structure, said central portion having a blind hole intended to receive a pivot of a rotating wheel set of the timepiece, the elastic structure and the central portion being formed by one single-piece part, said method comprising:

A) making a single crystal quartz wafer whose two main faces, respectively the first and second faces, are substantially oriented perpendicularly to the optical axis of the crystalline structure of the single crystal quartz;

B) forming a first initial mask on the first face of the single crystal quartz wafer, said first mask being structured by photolithography so as to define on said first face the contour of said elastic structure but not the contour of said blind hole;

C) partially machining said elastic structure, defined by the first initial mask, in said single crystal quartz wafer by placing said wafer in a chemical etching bath adapted for an anisotropic etch of single crystal quartz greatly facilitating an etch along said optical axis, said first initial mask being selected to resist the etch of said chemical etching bath;

D) structuring said first initial mask so as to define the contour of said blind hole and to obtain a first final mask;

E) final machining of said elastic structure and simultaneous machining of said blind hole, in said single crystal quartz wafer by placing said wafer in said chemical etching bath again.

6. The method according to claim 5, wherein, between forming a first initial mask on the first face of the single crystal quartz wafer and partially machining said elastic structure, a photosensitive layer, deposited on said first initial mask and used for structuring said first initial mask, is illuminated to subsequently form in said photosensitive layer a hole corresponding to said blind hole.

7. The method according to claim 5, wherein, prior to partially machining said elastic structures, a second mask is formed on the second face of the single crystal quartz wafer, said second mask being structured by photolithography so as to define the contour of the elastic structure on said second face.

8. The method according to claim 5, wherein said machined elastic structure has a design with curved slots and/or apertures whose edges at least partially define curved lines.

9. The method according to claim 5, wherein said blind hole has three oblique facets together defining a truncated or non-truncated trigonal pyramid.

* * * * *